US005616041A

United States Patent [19]

Brown et al.

[11] Patent Number: 5,616,041

[45] Date of Patent: Apr. 1, 1997

[54] FEMALE CONNECTOR FOR A PLASTIC MOLDED RECEPTACLE AND AN EXTENSION CORD

[75] Inventors: Donald C. Brown, Freehold; Suzanne V. Hickey, Brick, both of N.J.

[73] Assignee: Heyco Stamped Products, Inc., Toms River, N.J.

[21] Appl. No.: 524,895

[22] Filed: Sep. 7, 1995

Related U.S. Application Data

[63] Continuation of Ser. No. 373,900, Jan. 17, 1995, abandoned.

[51] Int. Cl.[6] ..... H01R 27/00

[52] U.S. Cl. ..... 439/222

[58] Field of Search ..... 439/217, 218, 439/222, 223, 856, 857

[56] References Cited

U.S. PATENT DOCUMENTS

| | | | |
|---|---|---|---|
| 1,146,938 | 7/1915 | Hubbell | 439/223 |
| 1,582,957 | 12/1922 | Avery | 439/223 |
| 1,591,773 | 7/1926 | Nero | 439/539 |
| 1,602,370 | 10/1926 | Avery | 439/223 |
| 1,635,056 | 7/1927 | Paiste | 439/223 |
| 1,639,541 | 8/1927 | Stacey | 439/652 |
| 2,675,527 | 4/1954 | Hartfranft | 439/107 |
| 2,965,869 | 12/1960 | Ludwig | 439/223 |
| 3,823,392 | 7/1974 | Pfeifer | 439/856 |
| 3,951,489 | 4/1976 | Bromberg | 439/107 |
| 4,229,465 | 10/1980 | Jaconette | 439/858 |
| 4,404,824 | 10/1983 | Weidler | 439/857 |
| 4,460,239 | 7/1986 | Inoue | 439/786 |
| 5,171,168 | 12/1992 | Chiodo | 439/651 |

FOREIGN PATENT DOCUMENTS

| | | | |
|---|---|---|---|
| 0411216 | 8/1989 | European Pat. Off. . | |
| 447664 | 4/1992 | European Pat. Off. | 439/857 |

OTHER PUBLICATIONS

Heyco Stamped Products, Inc. Part Drawing 7227-001—EC60-12.

*Primary Examiner*—Gary F. Paumen
*Attorney, Agent, or Firm*—Auslander & Thomas

[57] ABSTRACT

A female connector has a folded pair of arms with a pair of juxtaposed slots apposed to a pair of perpendicular arms form the same spine. The arms flex to blade open width when molded into a receptacle. The arms are strong and resilient and flex free of the molding plastic. In cold temperatures there is only a small surface contact between the arms and the molded plastic allowing the arms to flex to receive blades unimpeded by the plastic. An extension cord for outdoor use with the female connector can receive 15 amp or 20 amp plug blades in temperatures at least as low as −10° C.

13 Claims, 4 Drawing Sheets

FIG.4
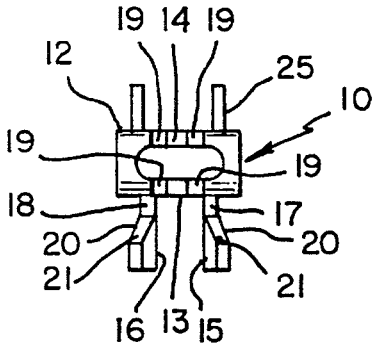
FIG.1
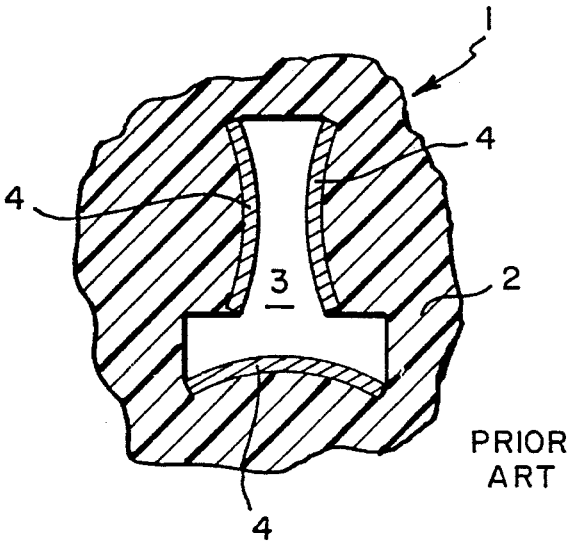
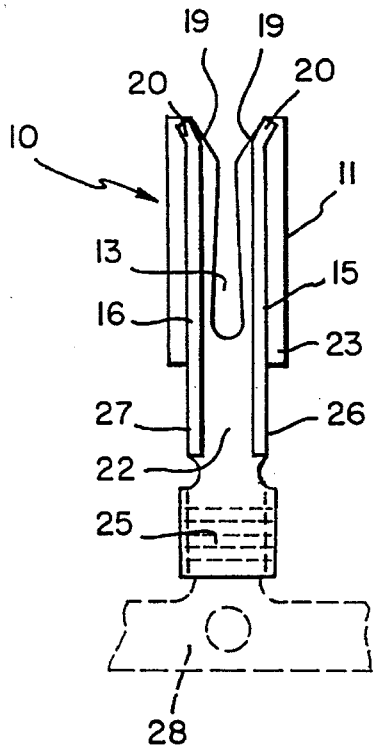
FIG.2
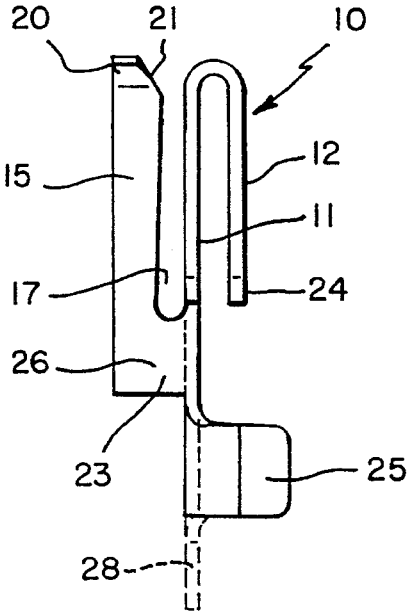
FIG.3

FIG.5
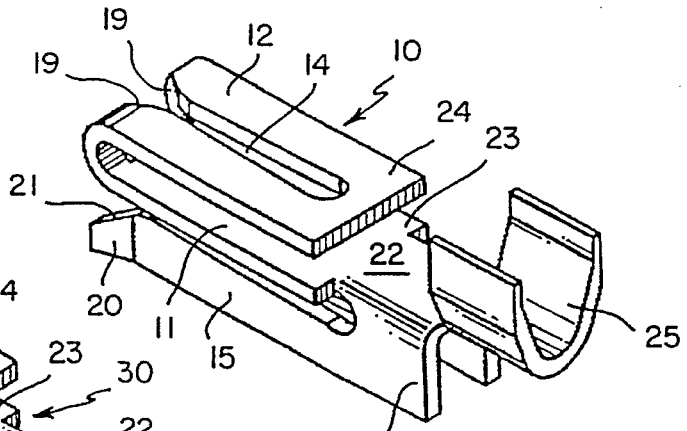
FIG.6
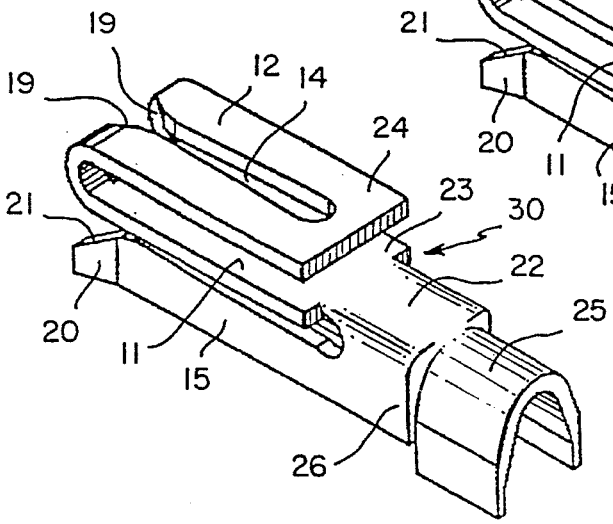
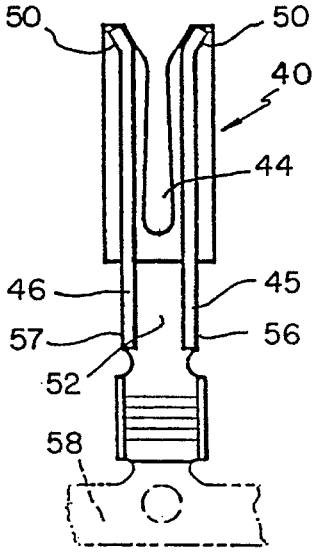
FIG.7
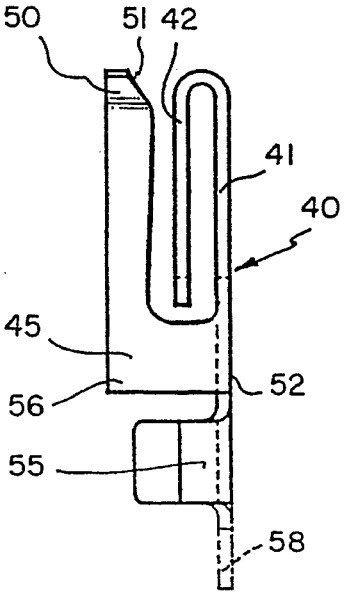
FIG.8

FIG.9
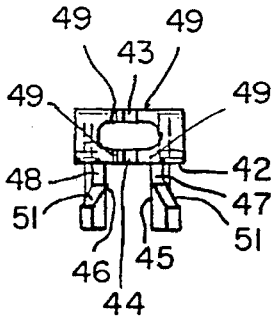
FIG.10
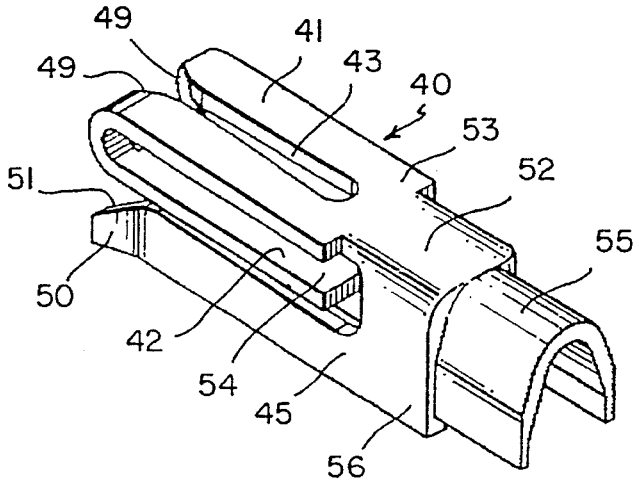
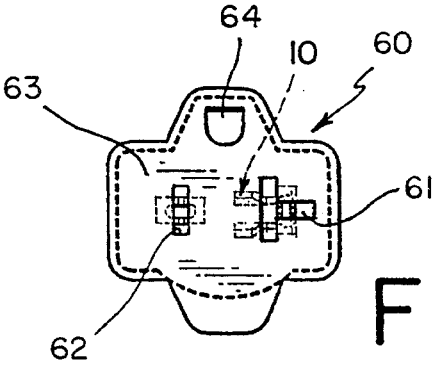
FIG.11
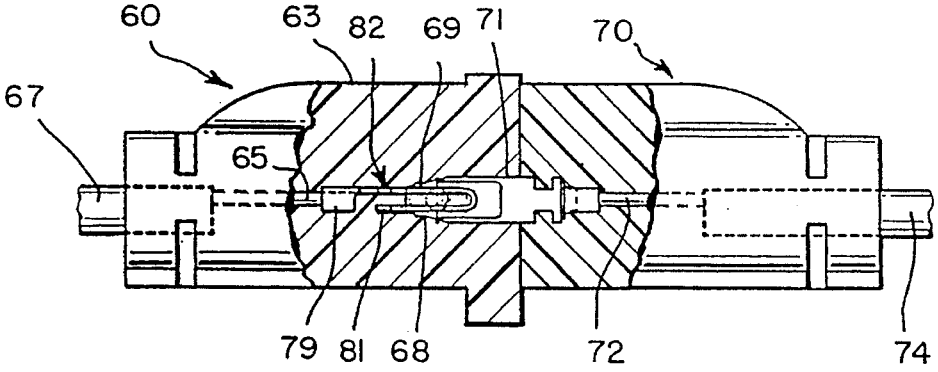
FIG.12

FIG.13
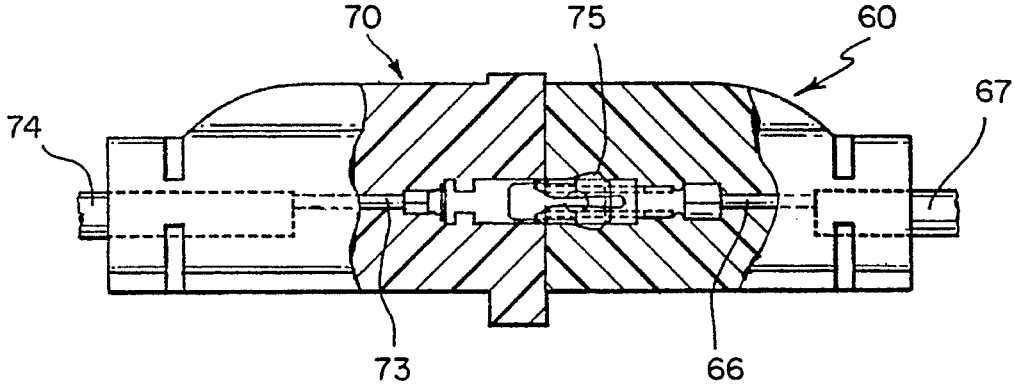
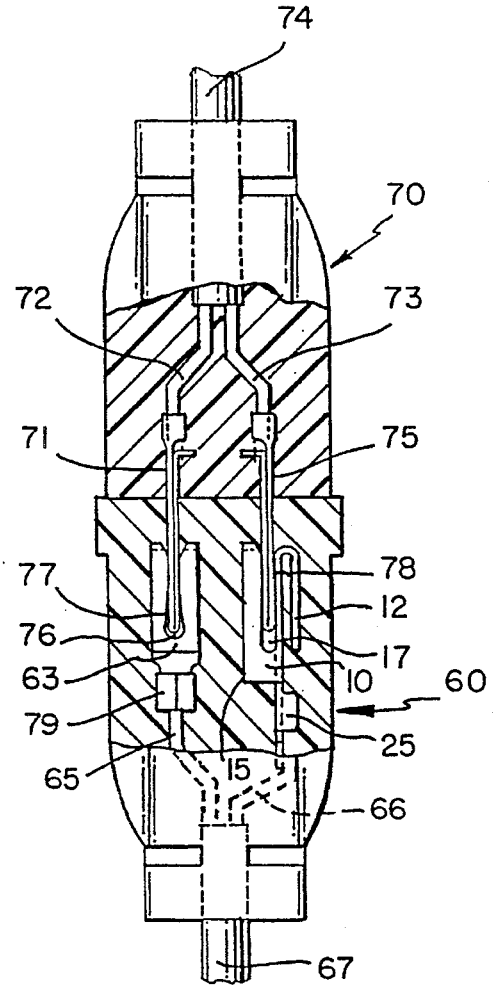
FIG.14
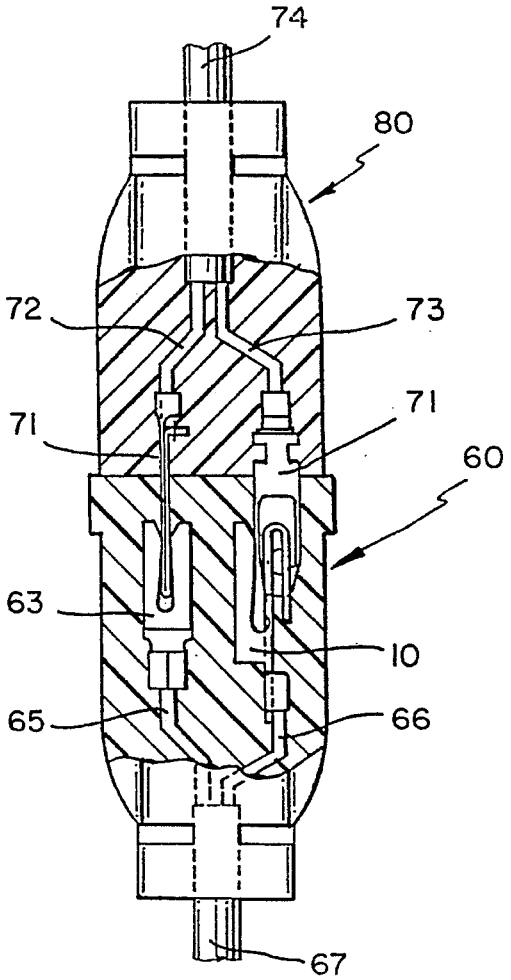
FIG.15

FEMALE CONNECTOR FOR A PLASTIC MOLDED RECEPTACLE AND AN EXTENSION CORD

This a continuation of application Ser. No. 08/373,900, filed Jan. 17, 1995, now abandoned.

BACKGROUND OF THE INVENTION

Extension cords for 120 Volt A.C. outdoor use, in order to meet Underwriter Laboratories specifications must be able to receive the blade of an inserted plug at temperatures down to −10° C.

Underwriter Laboratories also requires the 20 amp receptacle openings to be at a right angle to each other and 15 amp receptacles openings to have parallel openings. Receptacles to receive both 15 amp and 20 plugs have T shaped openings.

Extension cords, particularly for outdoor use, have molded plastic receptacles. The cold hardens the plastic so that conventional female electric connectors in molded receptacles, such as made with the prior art Pfeifer, U.S. Pat. No. 3,823,392, cannot receive a blade from a male plug in cold temperatures.

Conventional 120 Volt A.C. wall receptacles are adapted to receive both 15 amp and 20 amp plug blades by having a T shaped opening. The advantage of this is that one receptacle can serve a dual purpose. There is a convenience and an economic saving of not having to provide two separate receptacles.

In the conventional wall receptacle including a T shaped opening, the female connectors are usually large stamped parts which are held, or riveted in place. The receptacles are usually hard baked plastic not in contact with the female connectors. Such receptacles are generally not subjected to great temperature differences, particularly cold temperature. They present no difficulty to male plug blades.

A prior art edge connecting female connector, such as the HEYCO® 7227 part, adapts to molding into a plastic receptacle with limited surface contact when the plastic gets hard at −10° C. The HEYCO® 7227 allows a plug blade to enter. The 7227 female connector can be used in an extension cord for either a 15 amp receptacle or a 20 amp receptacle.

The 7227 female connector avoids the pressure of the cold molded plastic. When it is molded it is held open by the load bar. The folded arms of the female connector spring back into position, leaving a space in the plastic for it to flex into, once the load bar is removed. There is little surface contact between the plastic and the edges of the female connector. Thus, in the cold, the resilience of the metal and the hardness the cold plastic does not impede the entry of a plug blade.

The 7227 female connector cannot function to engage both a blade from a 15 amp plug or a blade from a 20 plug through a T opening in the receptacle.

A female connector from the conventional 120 Volt A.C. wall receptacle, which has a T shaped opening if molded into a plastic receptacle, does not adapt to allow both the 15 amp plug blade and the 20 amp plug blade to enter. At least two arms are always in full surface contact with the molded plastic of the mold and bind in the −10° C. temperature.

The present invention provides a female T connector usable in a molded plastic extension cord that overcomes the above mentioned problems.

The female connector of the present invention can be progressively stamped on a linked stamping strip. The linked stamping strip enables automation in the assembly of wire sets used in the molding of extension cords with molded receptacles with T openings and the female T connector. The wire sets provide an economy in labor and material in the manufacture of the extension cords and are an enablement for further economies in labor saving and automation. The wires may be machine crimped to the female connectors.

DESCRIPTION OF THE RELATED ART

Annexed hereto is Form PTO-1449 and copies of the patents and prior art cited therein.

The HEYCO® part drawing for part number 7227 dated Apr. 6, 1992 discloses prior art folded arm female edge connector.

U.S. Pat. No. 2,965,869 discloses a prior art wall type T opening receptacle with a two part hard plastic housing into which uncrimped longitudinal multiple female connectors may be placed engaged in the housing. The female T connectors 34 are edge connectors which sit unencumbered in the housing. The contacts 34 are without individual crimps.

U.S. Pat. No. 3,823,392 discloses a prior art folded metal non T female connector.

U.S. Pat. No. 1,146,938 discloses a multi part riveted set of connectors with spring plates 22 and 24 in a wall receptacle. The spring plates, if molded in plastic, would present a large surface in contact with the molded plastic.

U.S. Pat. No. 1,582,957 discloses a bent set of spring plates 13 and 14 in a wall receptacle. The spring plates, if molded in plastic, would present a large surface in contact with the molded plastic.

U.S. Pat. No. 1,591,773 discloses a bent set of spring plates in a wall receptacle similar to the plates in the '938 and '957 patents.

U.S. Pat. No. 1,602,370 discloses a bent set of spring plates in a wall receptacle similar to the plates in the '938, '957 and '773 patents.

U.S. Pat. No. 1,635,056 discloses a bent set of spring plates in a wall receptacle similar to the plates in the '869 patent.

U.S. Pat. No. 2,675,527 discloses a set of prongs aligned along a transverse axis.

U.S. Pat. No. 3,951,489 discloses in FIG. 6 and FIG. 15 a female connector system for a wall receptacle.

U.S. Pat. No. 4,229,065 discloses a female electrical connector with multiple arm female contacts.

U.S. Pat. No. 4,460,239 discloses a female connector to receive conductors at right angles and having a flat tab apposed to a folded metal spring like portion.

U.S. Pat. No. 5,171,168 discloses a female edge connector molded into a combination plug without a T opening in the receptacle.

European Patent Application No. 0 441 216 A1 discloses a receptacle with female contacts for right angulated openings having spring leaves and receiving plates.

Offenlegungsschrift No. 2 425 522 discloses a flat contact to receive perpendicular blades.

It is respectfully requested that this citation of art be made of record with regard to the within application.

SUMMARY OF THE INVENTION

The present invention is a female connector particularly adapted for 120 Volt A.C. extension cords for outdoor use.

The extension cords have molded plastic receptacles with T openings. The female connector can receive both 15 amp or 20 amp plug blades at temperatures at least as low as −10° C.

The prior art edge connectors do not adapt to a single extension cord that could accept both the 15 amp and 20 amp plug blades in an outdoor environment.

According to the present invention a female connector is provided for a molded plastic receptacle that has a T opening. The female connector can receive a male blade at a low temperature. The female connector has a spine, a first arm and a second arm that are contiguous to each other. The arms are substantially the same length, bent over each other, substantially parallel, spaced away a short distance, and integral to the spine. There are first and second slots, apposed to each other in the first and second arms. A third and fourth arm extends from the spine, perpendicular to the first and second set of arms, spaced away a short distance from the first and second arms. There are third and fourth slots between the third and fourth arms and the adjacent portion of whichever of the first or second arms is adjacent.

At least one of the slots includes guide means for guiding entry of a male blade. The slots may have an open portion and a bottom portion, sloping from the open portion to a wider bottom portion and at least one of the bottom portions may be rounded.

The female connector may have an integral crimp end, with crimp arms outward or inward from the spine.

The first arm may extend outward or inward spaced away from the spine.

The arms may have end portions extending beyond the bottom of the slots.

The female connector may be on a stamping strip having a strip end.

An extension cord may have a molded plastic female receptacle with female connectors to receive male blades at a low temperature. The receptacle may have a pair of the openings that are parallel, spaced apart and an opening having an intermediate perpendicular inner arm. The receptacle may have at least one female connector with a spine, a first arm and a second arm, integral to each other, substantially the same length, bent over each other, substantially parallel, spaced away a short distance, and integral to the spine. The female connector has first and second slots, apposed to each other in the first and second arms. A third and fourth arm extends from the spine, perpendicular to the first and second of arms, spaced away a short distance from the first and second arms. There are third and fourth slots between the third and fourth arms and the adjacent portion of whichever of the first or second arms is adjacent. The receptacle may have a ground pin opening and a female ground pin connector.

Although such novel feature or features believed to be characteristic of the invention are pointed out in the claims, the invention and the manner in which it may be carried, may be further understood by reference to the description following and the accompanying drawing.

BRIEF DESCRIPTION OF THE DRAWING

FIG. 1 is an enlarged detail of a horizontal section through a prior art molded receptacle showing a T opening with the plastic abutting the arms of a prior art female connector.

FIG. 2 is a top plan view of the female connector of the present invention on a stamping strip which is shown in phantom.

FIG. 3 is a right side elevation of FIG. 2.

FIG. 4 is upper end view of FIG. 2.

FIG. 5 is a perspective view of the female connector of FIG. 2.

FIG. 6 is a perspective view of another embodiment of the female connector of FIG. 2 with a different facing crimp end.

FIG. 7 is top plan view of another embodiment of the female connector of FIG. 2 on a stamping strip which is shown in phantom.

FIG. 8 is a right side elevation of FIG. 7.

FIG. 9 is upper end view of FIG. 7.

FIG. 10 is a perspective view of the female connector of FIG. 7.

FIG. 11 is front elevation view of a receptacle with a T opening including the female connector of FIGS. 2–5.

FIG. 12 is a cut away front elevation of a 15 amp plug with blades in a receptacle of FIGS. 11.

FIG. 13 is a 180° rotated cut away front elevation of FIGS. 12.

FIG. 14 is a 90° clockwise rotated cut away bottom plan view of FIG. 12.

FIG. 15 is a view of FIG. 14 with a 20 amp plug with blades engaged in the receptacle of FIGS. 11.

Referring now to the figures in greater detail, where like reference numbers denote like parts in the various figures.

DESCRIPTION OF THE PREFERRED EMBODIMENTS

FIG. 1 is an enlarged detail of a horizontal section through a prior art molded plastic receptacle 1. The molded plastic receptacle 1 is made of molded plastic 2 defining the T opening 3 and abutting the female connector arms 4.

In FIGS. 2–5, the female connector 10 of the present invention is shown having a first arm 11 and a second arm 12. There is a first slot 13 in the first arm 11 and a second slot 14 in the second arm 12.

There is a third arm 15 and a fourth arm 16, both arms are perpendicular to the first and second arms 11, 12. The third arm 15 and a fourth arm 16 define the third slot 17 and fourth slot 18 between them and the first arm 11.

The first arm 11 and second arm 12 are contiguous and are bent over each other, spaced away a short distance.

The first slot 13 and second slot slot 14 are aligned and include chamfers 19 at the rounded end of the first and second arms 11, 12, which lead into the slots 13, 14. The slots 13, 14 widen towards the bottom. The slots 13, 14 end at a rounded bottom. The third arm 15 and fourth arm 16 have bent away ends 20 substantially parallel to the chamfers 19.

The ends of the third and fourth arms 15, 16 also include chamfers 21.

The first and second arms 11, 12 have respective ends 23 and 24. The third and fourth arms 15, 16 bend off the spine 22 at a right angle to the first and second arms 11, 12. The third and fourth arms 15, 16 have respective arm ends 26 and 27.

A crimp end 25 extends longitudinally integral from the spine 22 with its crimp arms extending perpendicularly outward.

As can be seen in FIGS. 2 and 3, the female connectors 10 can come off a stamping strip (not shown) and joined on the stamping strip by the strip end 28, which is shown in phantom.

The female connector 30, shown in FIG. 6, is identical to the female connector 10 with the exception that the crimp end 25 extends longitudinally integral from the spine 22 with its crimp arms extending perpendicularly inward.

In FIGS. 7–10, the female connector 40 of the present invention is shown having a first arm 41 and a second arm 42. There is a first slot 43 in the first arm 41 and a second slot 44 in the second arm 42.

There is a third arm 45 and a fourth arm 46, both arms are perpendicular to the first and second arms 41, 42. The third arm 45 and a fourth arm 46 define the third slot 47 and fourth slot 48 between them and the second arm 42.

The first arm 41 and second arm 42 are contiguous and are bent over each other, spaced away a short distance. The arm 42 is folded inward of the spine 52 and perpendicular to the arms 45, 46.

The first slot 43 and second slot slot 44 are aligned and include chamfers 49 at the rounded end of the first and second arms 41, 42, which lead into the slots 43, 44. The slots 42, 44 widen towards the bottom. The slots 43, 44 end at a rounded bottom. The third arm 45 and fourth arm 46 have bent away guide ends 50 substantially parallel to the chamfers 49.

The ends of the third and fourth arms 45, 46 also include chamfers 51.

The first and second arms 41, 42 have respective ends 53 and 54. The third and fourth arms 45, 46 bend off the spine 52 at a right angle to the first and second arms 41, 42. The third and fourth arms 45, 46 have respective arm ends 56 and 57.

The crimp end 55 extends longitudinally integral from the spine 52 with its crimp arms extending perpendicularly inward.

As can be seen in FIGS. 7 and 8, the female connectors 40 can come off a stamping strip (not shown) and joined on the stamping strip by the strip end 58, which is shown in phantom.

FIGS. 11–14 shows a molded plastic receptacle 60 with a T opening 61. As shown in FIG. 11 the receptacle 60 also has an small single opening 62 parallel to the adjacent arm of the longer T opening 61 and a ground pin opening 64.

As shown in FIGS. 12–14, the receptacle 60 has a mating plug 70 of molded plastic. The plug 70 is a conventional 15 amp plug with parallel blades 71 and 75. The blade 71 has a narrow end 77 that can fit into the either opening 61 or 62. The blade 75 has a wide end 78 that can only fit into either slot of the T opening 61. The blades 71, 75 are crimped to lines 72 and 73, which extend from a cable 74. The cable 74 is molded into the plug 70.

In FIG. 12–14, the receptacle 60 is of molded plastic and is shown receiving the 15 amp plug with parallel blade 71 engaged in the slots 76 of the folded arms 68 and 69 of the folded female connector 63. The female connector 63 is crimped to line 65 which extends from a cable 67. Line 66 also extends from the cable 67 and is crimped to crimp end 25 of the female connector 10. The female connector 63 has a first arm end 81 adjacent its crimp end 79 and a second arm end 82. The blade 75 is engaged in the slots 17 and 18 of the female connector 10.

FIG. 15 shows a receptacle, as shown in FIG. 14, with a conventional 20 amp plug 80 with two blades 71. The second blade 71 is perpendicular to the first and engages the slots 13 and 14 of the female connector 10.

Operation

The present invention is an outdoor use extension cord for both 15 amp and 20 amp 120 Volt A.C. current. The extension cord is enabled by the female connectors 10, 30, and 40.

The female connectors 10, 30, and 40 enable the molded plastic receptacle 60 to receive the necessary combination of plug blades down to −10° C.

Intrinsic to a receptacle to receive both 15 amp and 20 amp plug blades is the T opening. The prior art T opening is well known in the art in connection with wall receptacles. The usual wall receptacle is seldom if ever subjected to big temperature variations and is made with cavitations for the connectors.

The usual female connector for the T opening in a wall receptacle is some form of folded metal three arm device or some form of T slotted female connector. The mere using of such connectors in a molded receptacle does not enable effective reception of the male contact blade of a plug at low temperatures.

FIG. 1 shows a section through a typical molded plastic receptacle 1 with prior art female connector arms 4 molded into the molded plastic 2. In low temperatures the cold hardens and restricts the contacts in the opening 3 so that a male blade cannot enter. There is a large surface of the molded plastic 2 directly abutting female connector arms 4.

Female connectors such as the HEYCO® 7227 are made on progressive stamping strips and can be automatically fed to machinery to have wires automatically crimped to them. They may be fed from their stamping strips, held on strip ends or hopper fed. The 7227 female connectors were adapted to withstand low temperatures in 15 amp and 20 amp receptacles but the 7227 female connectors could not serve a T opening in a molded receptacle.

The present invention female connector 10 is adapted for automated crimping and the necessary temperatures constraints in a molded receptacle with a T opening.

The present invention is a double folded arm edge connecting female connector that makes contact through a T opening to either a 15 amp plug parallel blade or a 20 amp plug blade perpendicular blade. All such contact is at four points on either blade.

In the making of an outdoor use extension cord for both a 15 amp and 20 amp 120 Volt A.C., a female connector 10, 30 or 40 is preferably machine crimped to a line 66 of a cable 67. A folded female connector 63 is likewise crimped to a line 65 of the cable 67. A load bar (not show) is engaged in the slot 76 of the folded female connector 63 and in the slots 17, 18, 13, 14 or slots 47, 48, 43, 44 of the female connectors 10, 30 or 40.

Further references will be restricted to female connector 10 in a molded plastic receptacle 60 with a plug 70 with blades 71 and 75 unless specific reference is made to other items, since the operation of all the embodiments are substantially similar, with minor variations.

The load bars in the slot 76 and the slots 13, 14, 17 and 18 bias the arms 11, 12, 15 and 16 away, leaving the spaces between the arms 11, 12, 15 and 16 the normal width of the usual entering blade. The slots 13, 14, 17 and 18 taper to narrower widths from their bottoms to the ends of the chamfers 19 and 21. Thus, in normal use, there is a spring bias to grasp an inserted blade and keep it from falling out.

Once the plastic for molding the molded plastic receptacle 60 has been cast and the load bars removed, the arms 11, 12, 15 and 16 that form the slots 13, 14, 17 and 18 in female connector 10 resume their normal shape. There is a small surface contact between the molded plastic of the molded plastic receptacle 60 and there is a small gap in the molded plastic into which the arms 11, 12, 15 and 16 may recede when they are spread by an inserted blade.

At low temperatures, there is only small surface contact that can act against the arms 11, 12, 15 and 16 and there is a gap in the plastic that does not impede the necessary spreading of the arms 11, 12, 15 and 16.

The ends 26 and 27 prevent the arms from being bound by the plastic. The ends 26 and 27 are perpendicular to the longitudinal plane of the female connector 10, so that the arms 15 and 16 when spread by the load bar, create a clear path to flex even in low temperatures.

The mass of the ends 26 and 27 prevents the arms 15 and 16 from being a simple hinge at the bottom of the slots 17 and 18, to be easily immobilized by the mass of the low temperature plastic and prevent the arms 15 and 16 from flexing and not admit a plug blade.

The slots 17 and 18 differ from the slots 13 and 14 in that there is only a single outward taper downward to the bottom of the slots 17 and 18 in the arms 15 and 16. The opposite side of the slots 17 and 18 is the flat face of the first arm 11.

The ends 23 and 24 perform the same function perpendicular to the plane of the arms 15 and 16 and for the same reason.

As can be seen, the simple providing of a central slot in a female connector, such as shown in FIG. 2 or FIG. 10, if U.S. Pat. No. 3,823,392 could not allow the arms of the female connector to admit a plug blade in at least one direction, since the entire body of a low temperature molded plastic would impinge on the leg portions 15, 16, and 17, along their length, and apply pressure against entry of the plug blade. If the contacts were molded open the metal contacts would not exert sufficient pressure by themselves to retain the male plug at normal temperatures.

The folding of the arms 11 and 12 enables the economy of being able to provide good structural strength to the female connector 10 with less metal. The electrical contact with the engaged blade is the equivalent, or better, than that of a metal connector 0.045 thick.

The terms and expressions which are employed are used as terms of description; it is recognized, though, that various modifications are possible.

It is also understood the following claims are intended to cover all of the generic and specific features of the invention herein described, and all statements of the scope of the invention which, as a matter of language, might fall therebetween.

Having described certain forms of the invention in some detail, what is claimed is:

1. A female connector for a molded plastic receptacle including a T opening, said female connector to receive a male blade at a low temperature, said female connector including a spine, a first arm and a second arm, said first and second arms being substantially the same length, bent over each other, substantially parallel, spaced apart a short distance, and one-piece with said spine; said first and second arms having first and second slots, respectively, opposed to each other; and a third and fourth arm extending from said spine perpendicular to said first and second arms and spaced a short distance therefrom.

2. The invention of claim 1 wherein at least one of said slots includes guide means for guiding entry of a male blade.

3. The invention of claim 1 wherein said slots have an open portion and a bottom portion, each said slot sloping from said open portion to a wider bottom portion.

4. The invention of claim 3 wherein at least one said bottom portion is rounded.

5. The invention of claim 1 wherein said female connector includes an integral crimp end.

6. The invention of claim 5 wherein said crimp end includes crimp arms, said crimp arms extending outward from said spine.

7. The invention of claim 5 wherein said crimp end includes crimp arms, said crimp arms extending inward from said spine.

8. The invention of claim 1 wherein said first arm extends from said spine and said second arm is spaced away outward from said spine.

9. The invention of claim 1 wherein said first arm extends from said spine and said second arm is spaced away inward from said spine.

10. The invention of claim 3 wherein said arms include end portions, said end portions extending beyond said bottom of said slots.

11. The invention of claim 1 in combination with a stamping strip, said stamping strip including a strip end, and at least one said female connector on said strip end.

12. An extension cord including a molded plastic female receptacle and female connectors to receive male blades at a low temperature, said receptacle including at least two openings, at least a pair of said openings being parallel and spaced apart a short distance; at least one of said openings having an intermediate perpendicular arm; at least one of said female connectors including a spine, a first arm and a second arm; said first and second arms being substantially the same length, bent over each other, substantially parallel, spaced apart a short distance, and one-piece with said spine; said first and second arms having first and second slots, respectively, opposed to each other; and a third and fourth arm extending from said spine perpendicular to said first and second arms and spaced a short distance therefrom.

13. The invention of claim 12 wherein said receptacle includes a ground pin opening and a female ground pin connector.

* * * * *